US007418955B1

(12) United States Patent
Hankins

(10) Patent No.: US 7,418,955 B1
(45) Date of Patent: Sep. 2, 2008

(54) FUEL SAVINGS DEVICE AND METHODS OF MAKING THE SAME

(76) Inventor: James Dwayne Hankins, 19981 Hwy Z, Everton, MO (US) 65646

( * ) Notice: Subject to any disclaimer, the term of this patent is extended or adjusted under 35 U.S.C. 154(b) by 33 days.

(21) Appl. No.: 11/483,762

(22) Filed: Jul. 9, 2006

(51) Int. Cl.
*F15C 1/04* (2006.01)

(52) U.S. Cl. ..... 123/538

(58) Field of Classification Search ..... 123/536–538
See application file for complete search history.

(56) References Cited

U.S. PATENT DOCUMENTS

| | | | | |
|---|---|---|---|---|
| 1,771,626 | A | 7/1930 | Hamilton | |
| 3,110,294 | A * | 11/1963 | Nyman | 123/536 |
| 3,110,924 | A | 11/1963 | Nyman | |
| 4,023,544 | A * | 5/1977 | Cole | 123/537 |
| 4,203,398 | A * | 5/1980 | Maruoka | 123/701 |
| 4,380,978 | A * | 4/1983 | Maynard et al. | 123/275 |
| 4,582,475 | A * | 4/1986 | Hoppie | 431/6 |
| 4,605,523 | A | 8/1986 | Smillie | |
| 4,672,938 | A * | 6/1987 | Hoppie et al. | 123/538 |
| 5,313,123 | A * | 5/1994 | Simuni | 310/11 |
| 5,377,648 | A | 1/1995 | Iwata | |
| 5,517,975 | A | 5/1996 | Iwata | |
| 6,167,872 | B1 * | 1/2001 | Campagna et al. | 123/538 |
| 6,748,933 | B2 | 6/2004 | Prévost | |
| 6,763,811 | B1 | 7/2004 | Tamol, Sr. | |
| 6,802,706 | B2 | 10/2004 | Collesan | |
| 6,971,376 | B2 | 12/2005 | Monette et al. | |

* cited by examiner

*Primary Examiner*—M. McMahon
(74) *Attorney, Agent, or Firm*—Richard L. Marsh

(57) ABSTRACT

An apparatus for enhancing fuel mileage of internal combustion engine consists of a tube inserted into a fuel line between a fuel storage tank and the engine, the tube having a plurality of electrodes protruding into a fuel passage within the tube. The electrodes are provided with an electrical charge for imparting electrical charges to liquid fuel molecules flowing through the fuel passage of the tube.

3 Claims, 5 Drawing Sheets

FUEL SAVINGS DEVICE AND METHODS OF MAKING THE SAME

BACKGROUND OF THE INVENTION

1. Field of the Invention

This invention relates to an apparatus for improving fuel mileage in an internal combustion engine.

2. Prior Art Statement

It is known to provide a device for purifying fuel which comprises at least one pair of arc-shaped conductive plates facing each other arranged on the outer periphery of a synthetic resin fuel communication pipe or a conductive element helically wound around the outer periphery of the synthetic resin fuel communication pipe. Either apparatus is electrically connected to a signal generator and is supplied with voltage ranging from 0.05-17 VAC, current from 250 μA to 3.0 mA at a frequency of 30-130 Hz. For instance, see the U.S. Pat. Nos. 5,377,648 and 5,517,975 issued on 3 Jan. 1995 and 21 May 1996 respectively to Iwata Yosihiro. The fuel molecules are claimed to be varied, broken up, so that the dissolved oxygen content of the fuel is increased and as a result the pollution gasses contained in the exhaust are reduced. Since the apparatus is disposed on the exterior of the fuel supply line, there is no direct interaction with the fuel and thus there is still a need for an apparatus that imparts an electrical charge to the molecules or chains of the fuel in order to assure alignment.

It is also known to provide a device for treatment of a fluid flowing through a fluid conduit comprising a first and a second wire element coiled around the conduit wherein the wires are spaced apart and preferably wound in opposed directions. The coils are alternately provided with 5Vdc square wave periodic signal. For instance, see U.S. Pat. No. 6,748,933 B2 issued on 15 Jun. 2004 to Jacques Prévost. The signal imparts a magnetic force upon the fuel and is not directly supplied in the fuel stream as the coils are external of the conduit wherein the external action causes frictional forces at the boundary layer of the flow stream. Thus, there is still a need for an apparatus that aligns the fuel molecules and chains by imparting an electrical charge to the fuel within the conduit.

It is further known to provide a method of enhancing combustion of fuel in a system comprising placing a configuration having either a magnetic field component or an electrical field component within the fuel inlet section wherein the configuration has a fluted wall forming a thin annular space between the configuration and the fuel inlet section whereby a film of fuel is forced to flow through the space. The fuel is claimed to be altered by creating free radicals or free ions. For instance, see the U.S. Pat. No. 6,763,811 B1 issued on 20 Jul. 2004 to Ronald A. Tamol, Sr. Since the fuel is forced to flow through a small space, greater pressures are required to properly flow the fuel through the system. Furthermore, since the field strength is imparted transverse to the flow of the fuel, that is, across the thin film, alignment with the flow direction is defeated. Finally, since free radicals are formed, potential energy of the fuel is reduced and affinity for ground potential is increased. Therefore, a great need exists for an apparatus that will add potential energy to fuel by linking to open bond sites and aligning the fuel molecules in the direction of fuel flow.

Additionally, it is known to provide a device to optimize combustion of hydrocarbons comprising a fuel feed pipe, at least one means to generate a magnetic field surrounding the fuel feed pipe wherein the magnetic field is driven by an electronic circuit which pulsates the magnetic field at a frequency between 1 and 30 Hz. The pulsating magnetic field is generally triangular in shape and is claimed to weaken the surface tension of drop of fuel which breaks up the drops into micro-drops while forming turbulence. A free end of one coil emits pulsating radio waves which is claimed to encourage the phenomena. For instance, see the U.S. Pat. No. 6,802,706 B2 issued on 12 Oct. 2004 to Antonio Collesan. The magnetic field is external of the fuel pipe and hence does not act directly upon the fuel, nor does the magnetic field affect the alignment or state of the molecules or chains in the fuel stream. Accordingly, there still is a need for an electrical stimulation of the molecules and chains to promote alignment of the chains with the path of flow and to attach to open bond sites on the chains.

Still further known is an electronic fuel conditioning device comprising a frequency controlled signal generator, a first output therefrom connected to a wire coiled around the fuel line for producing a first shark dorsal waveform at a predetermined frequency and a second output connected to a second wire coiled around the fuel line for producing a second shark dorsal waveform at a second frequency. For instance, see the U.S. Pat. No. 6,971,376 B2 issued on 06 Dec. 2005 to Monette, et al. Similar to Collesan, Iwata and Prévost, the field only peripherally acts upon the fuel in the pipe as there is no direct passage of the current in the fuel stream and thus this patent lacks means of electrical stimulation of the molecules and chains to promote alignment of the chains with the path of flow and to attach to open bond sites on the chains. Consequently, there is still a need for a fuel conditioning device which acts directly upon the fuel stream enhancing alignment of the molecules or chains with the fuel stream.

It is also known to provide an electrode between the intake manifold and the air intake which is claimed to charge the atomized hydrocarbon vapor wherein the electrode is provided with a high voltage and current density so there is a preponderance of discharged electricity of one polarity so the globules repel one another. Preferably, the electrode is negatively charged as low as 100 Vdc. For instance, see the U.S. Pat. No. 1,771,626 issued on 29 Jul. 1930 to Erwin H. Hamilton. Since one side of the is grounded to the engine and since the entire engine is metallic, ground potential exists everywhere and particularly in the intake tube which would draw the charged particles to the ground in the intake manifold thus defeating the purpose of charging the particles. Additionally, arcing may occur in the fuel/air mixture with potential disastrous results. Therefore, there is a need to provide a charge to fuel molecules in the fuel line that does not seek ground potential so that the molecules may carry any charge imparted thereto into the combustion chamber.

Another method claimed to charge the atomized hydrocarbon vapor comprises at least one pair of ionizing electrodes mounted in an elongated intake manifold pipe of about 50 mm diameter. A potential of up to 200 Vdc is applied to the ionizing electrodes which purportedly charges the particles in the region adjacent the ionizing electrodes. For instance, see the U.S. Pat. No. 3,110,924 issued on 12 Nov. 1963 to Bo Carl G. Nyman. Since only the particles in the region of the electrodes is charged, only a partial improvement can be achieved. Furthermore, since the tube is large in diameter, the higher electromotive force could result in arcing across the manifold causing pre-ignition in the intake manifold resulting in backfiring. Therefore, there is a need to charge the fuel molecules in the fuel line where combustion cannot take place as no oxidizer is present thus allowing the molecules to carry the charge into the combustion chamber.

Finally, it is known to provide an apparatus for improved fuel efficiency comprising a plurality of regularly spaced parallel plate electrodes of alternating charge disposed both halves of a chamber the chamber also enclosing a plurality of regularly spaced parallel plates of ferro-magnetic material disposed between the halves of the chamber. For instance, see the U.S. Pat. No. 4,605,523 issued on 12 Aug. 1986, to Winston B. Smillie. The entire combustion mixture comprising vaporized fuel in a quantity of air is subjected to the electrical charge and magnetic field and is further heated by exhaust gas passed through a central portion of the magnetic members. Accordingly, there is a high potential of combustion of the fuel/air mixture within the intake air stream, a generally undesirable condition. No particular information is supplied to support the postulation set forth in this application and it is believed by the inventor hereof that this apparatus provides no further benefit than previously known apparatus which heats the fuel/air mixture prior to entry to the combustion chambers. Furthermore, since the electrical plates are arranged in stacks, any charge imparted to the molecules or chains would be transverse to the direction of the flow and therefore counterproductive for aligning the molecules and chains in the direction of flow. Therefore, there is a great need for an apparatus to align fuel molecules and chains in the direction of fuel flow prior to mixture with air in order to achieve greater fuel efficiency.

SUMMARY OF THE INVENTION

A primary goal of this invention is to impart electrical charges to liquid fuel molecules flowing through the fuel passage of a fuel supply line of an internal combustion engine.

An object of this invention is to provide an apparatus for enhancing fuel mileage of an internal combustion engine, the apparatus consisting of a tube inserted into a fuel line between a fuel storage tank and the internal combustion engine, the tube having a plurality of electrodes protruding into a fuel passage within the tube, the plurality of electrodes provided with an electrical charge for imparting electrical charges to liquid fuel molecules flowing through the fuel passage of the tube.

Another object of this invention is to provide a fuel supply line insert comprising an elongated tube and a plurality of electrodes protruding into a fuel passage within the fuel supply line insert, the plurality of electrodes arranged on the orthogonal axes of the fuel passage, the electrodes imparting electrical charges to liquid fuel molecules flowing through the fuel passage, the plurality of electrodes provided with electrical charges of alternating polarity.

A significant feature of this invention is to provide a fuel supply line insert comprising an elongated tube and a plurality of electrodes protruding into a fuel passage, the plurality of electrodes arranged on the orthogonal axes of the fuel passage wherein the electrodes on a vertical axis are connected in parallel and are positively charged and the electrodes on a horizontal axis are connected in parallel and are negatively charged.

A main purpose of this invention is to provide an apparatus for enhancing fuel mileage of an internal combustion engine, the apparatus consisting of a tube inserted into a fuel line between a fuel storage tank and the internal combustion engine, the tube having a plurality of electrodes protruding into a fuel passage within the tube, the plurality of electrodes provided with an electrical charge for imparting electrical charges to fuel molecules passing through the apparatus wherein the electrodes are arranged in rows along the longitudinal axis of the tube and at the cardinal points of the axes perpendicular to the longitudinal axis wherein the electrodes lying upon the vertical axis are connected in series and the electrodes lying upon the horizontal axis are connected in series.

A primary principle of this invention is to provide an apparatus for enhancing fuel mileage of an internal combustion engine, the apparatus consisting of a tube inserted into a fuel line between a fuel storage tank and the internal combustion engine, the tube having a plurality of electrodes protruding into a fuel passage within the tube wherein the electrodes are disposed into the tube a distance of up to one-half the maximum dimension across the cross section of the fuel passage of the tube.

A principal aim of this invention is to provide an apparatus for enhancing fuel mileage of an internal combustion engine, the apparatus consisting of a tube inserted into a fuel line between a fuel storage tank and the internal combustion engine, the tube having a plurality of electrodes protruding into a fuel passage within the tube wherein the electrodes are provided with an electrical charge of 12 volts direct current.

A primary aspect of this invention is to provide an apparatus for enhancing fuel mileage of an internal combustion engine, the apparatus consisting of a tube inserted into a fuel line between a fuel storage tank and the internal combustion engine, the tube having a plurality of electrodes protruding into a fuel passage within the tube wherein the electrodes are provided with an electrical charge of 12 volts from the electrical system of the internal combustion engine.

Yet another aspect of this invention is to alleviate boundary layer problems as molecules are not drawn to inner surface of pipe upon exiting the apparatus of this invention.

DESCRIPTION OF THE PREFERRED EMBODIMENTS

Figure 1:
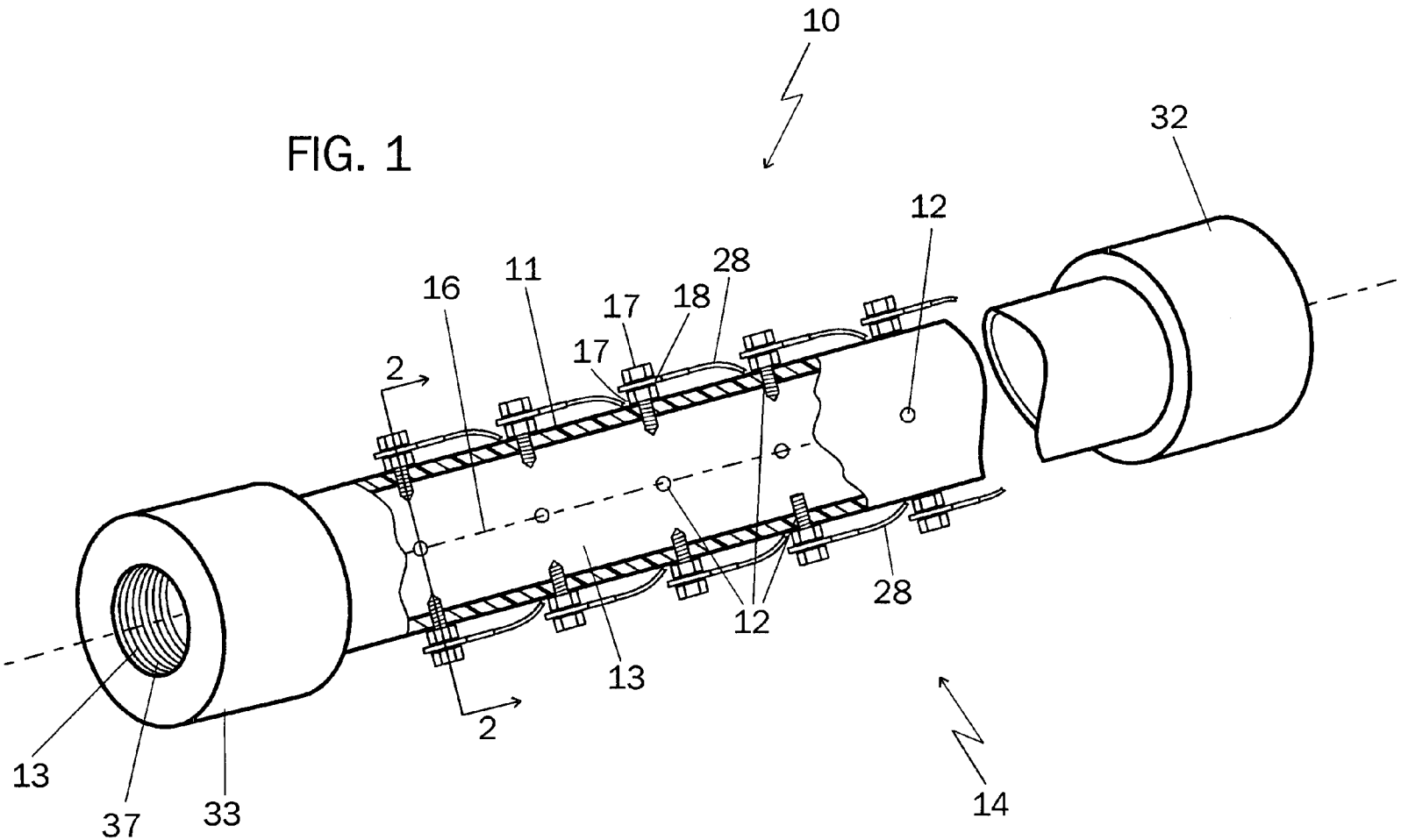
FIG. 1 is a perspective view of the preferred embodiment of the supply line insert of this invention with portions cut away to show internal structure.

While the various features of this invention are hereinafter described and illustrated as an apparatus to impart electrical charges to liquid fuel molecules flowing through the fuel passage of a fuel supply line of an internal combustion engine, it is to be understood that the various features of this invention can be used singly or in various combinations thereof impart a charge to the fuel flowing within a fuel supply line as can hereinafter be appreciated from a reading of the following description.

Referring now to the Figures, an apparatus for enhancing fuel mileage of an internal combustion engine 50 is generally shown by the numeral 10, apparatus 10 also referred to as a fuel supply line insert. Apparatus 10 consists of a tube 11 preferably inserted into a fuel line 51 between a fuel storage tank 52 and internal combustion engine 50, tube 11 having a plurality 14 of electrodes 12 protruding into a fuel passage 13 within tube 11, plurality 14 of electrodes 12 provided with electrical potential for imparting electrical charges to liquid fuel molecules flowing through fuel passage 13 of tube 11. Preferably, tube 11 is an electrically neutral tube such that electrodes 12 may be inserted directly through the wall 19 of tube 11, however, it is fully within the scope of this invention to electrically isolate electrodes 12 from wall 19 where tube 11 is a conducting material. In the preferred embodiment, tube 11 is made from an electrically insulating material such as polytetrafluoroethylene, polypropylene, polyethylene, polyamide, polyparabenzamide, silicone, viton, chloroprene, ethylene propylene polymer, isoprene, butyl, polystyrene or combinations thereof and may be compression molded, extruded, injection molded or machined from tubular material. Inlet and outlet connectors 32, 33 are provided with a threaded interior 37 for receiving a male fuel line coupler thereinto.

Electrodes 12 are preferably arranged in rows 20-23 parallel to a longitudinal axis 16 of tube 11, rows 20-23 also preferably arranged at the cardinal points on the orthogonal axes X, Y of tube 11 wherein the orthogonal axes X, Y are perpendicular to longitudinal axis 16. Though it is shown in FIG. 1 that rows 20-23 extend along substantially the full length of tube 11, rows 20-23 may be provided adjacent either end of tube 11 or in a central location thereof between an inlet connector 32 and an outlet connector 33. Additionally, it is within the scope of this invention to insert apparatus 10 in fuel line 51 between tank 52 and fuel pump 53 or between fuel pump 53 and engine fuel inlet 54 wherein engine fuel inlet 54 is a carburetor or fuel injection rail. It is also within the scope of this invention to replace fuel line 51 with apparatus 10 wherein rows 20-23 are arranged at a location adjacent a power source 55 at any point between inlet connector 32 and outlet connector 33.

Figure 4:
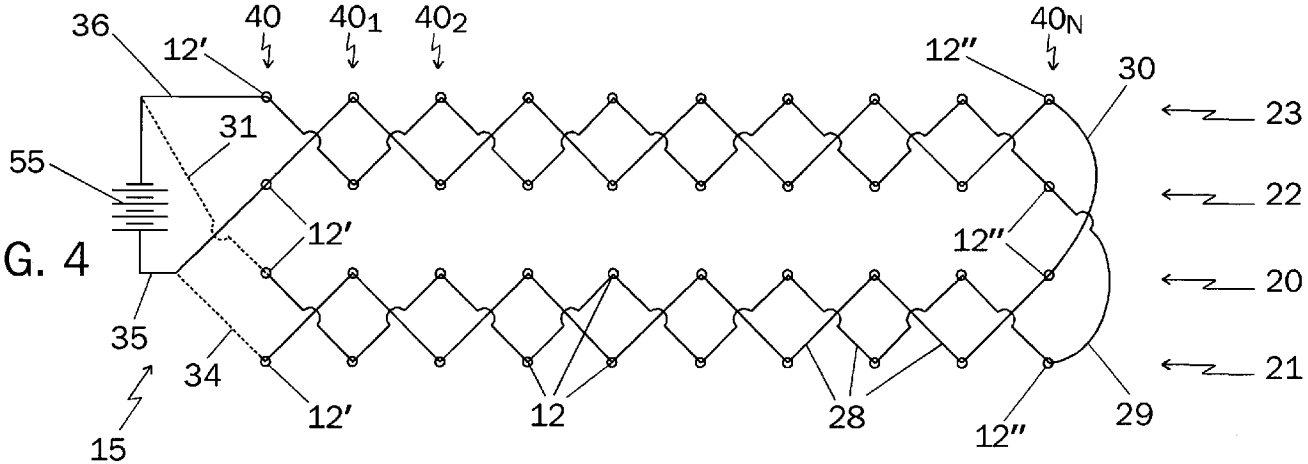
FIG. 4 is a preferred electrical schematic of the connections between electrodes of the apparatus of this invention, an first alternate connection shown in dashed lines.

Referring specifically to the preferred electrical schematic of FIG. 4, a first electrode 12' in row 23 is connected to a positive terminal of power source 55 with positive lead 36 while a first electrode 12' in row 22 is connected to a negative terminal ofpower source 55 with negative lead 35 wherein power source 55 shown as a battery. Electrodes 12 following first electrode 12' in each row 22, 23 are interconnected in a crisscross pattern along these row pairs 22, 23 so that each electrode 12 in each row 22, 23 is alternately charged. At a terminal electrode 12" of each row 22, 23, an end wire 29, 30, respectively, connects to the terminal electrode 12" of rows 21, 20 respectively, to provide electrical potential to rows 20, 21. Rows 20, 21 are also interconnected in a crisscross pattern along the row pair 20, 21 so that each electrode 12 in each row 20, 21 is also alternately charged. At first electrode 12' of rows 20, 21, no connection is provided back to power source 55, nor to another row nor to ground potential thus removing any electrical short providing a margin of safety for apparatus 10. Alternately, as shown in dashed lines 31, 34 in FIG. 4, rows 20 and 23 may be connected to the positive terminal of power source 55 with rows 21 and 22 connected to the negative terminal, however, end wires 29 and 30 are removed in this alternate embodiment. Again, since an open connection occurs now at terminal electrodes 12" of each row and no connection is provided back to power source 55, nor to another row nor to ground potential, the margin of safety for apparatus 10 is preserved. Though the specific connection to first electrode 12' of row 23 has been described as positively charged and the specific connection to first electrode 12' of row 22 has been described as negatively charged and end wires 29, 30 have been described as connecting rows 21, 22 and 20, 23 respectively, it is fully within the scope of this invention to reverse these connections or to start at rows 20, 21 or any other combination thereof.

Figure 5:
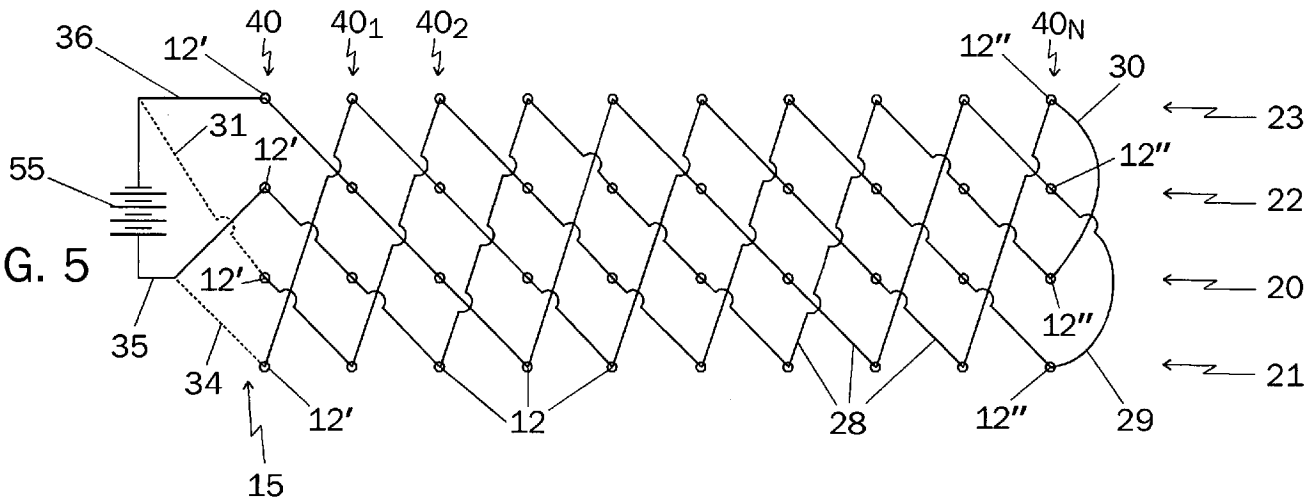
FIG. 5 is a second alternate electrical schematic of the connections between electrodes of the apparatus of this invention with a third alternate connection shown in dashed lines.

In FIG. 5, second and third alternate connections for electrodes 12 are shown. Specifically, first electrode 12' in row 23 is connected to the positive terminal of power source 55 with positive lead 36, connecting wire 28 connecting each successive electrode 12 of each row 22, 20, 21 in turn, returning to row 23 at the fifth electrode 12 wherein connecting wire 28 again connects each successive electrode 12 of rows 22,20,21 in turn until a terminal electrode 12" in row 22 is reached where end wire 29 connects terminal electrode 12" of row 22 to terminal electrode 12" in row 21. Connecting wire 28 then reverses direction connecting each successive electrode 12 of each row 20, 22, 23 in turn, returning to row 21 at the fifth electrode 12 wherein connecting wire 28 again connects each successive electrode 12 of rows 20, 22, 23 in turn until first electrode 12 in row 20. Also, first electrode 12' in row 22 is connected to the negative terminal of power source 55 with negative lead 35, connecting wire 28 connecting each successive electrode 12 of each row 20, 21, 23 in turn, returning to row 22 at the fifth electrode 12 wherein connecting wire 28 again connects each successive electrode 12 of rows 20, 21, 22 in turn until a terminal electrode 12" in row 20 is reached where end wire 30 connects terminal electrode 12" of row 20 to terminal electrode 12" in row 23. Connecting wire 28 then reverses direction connecting each successive electrode 12 of each row 21,20,22 in turn, returning to row 23 at the fifth electrode 12 wherein connecting wire 28 again connects each successive electrode 12 of rows 21, 20, 22 in turn until reaching first electrode 12' in row 21. As with the preferred embodiment, first electrode 12' in row 20 and 21 are not connected to anything thus reducing any potential for arcing to again preserve the margin of safety for apparatus 10. In a third alternate connection, first electrode 12' in rows 23 and 20 are connected to the positive terminal of power source 55 with leads 31, 36 and first electrode 12' in rows 21 and 22 are connected to the negative terminal of power source 55 with leads 34, 35, however, end wires 29 and 30 are removed from terminal electrodes 12" of rows 20-23.

Figure 6:
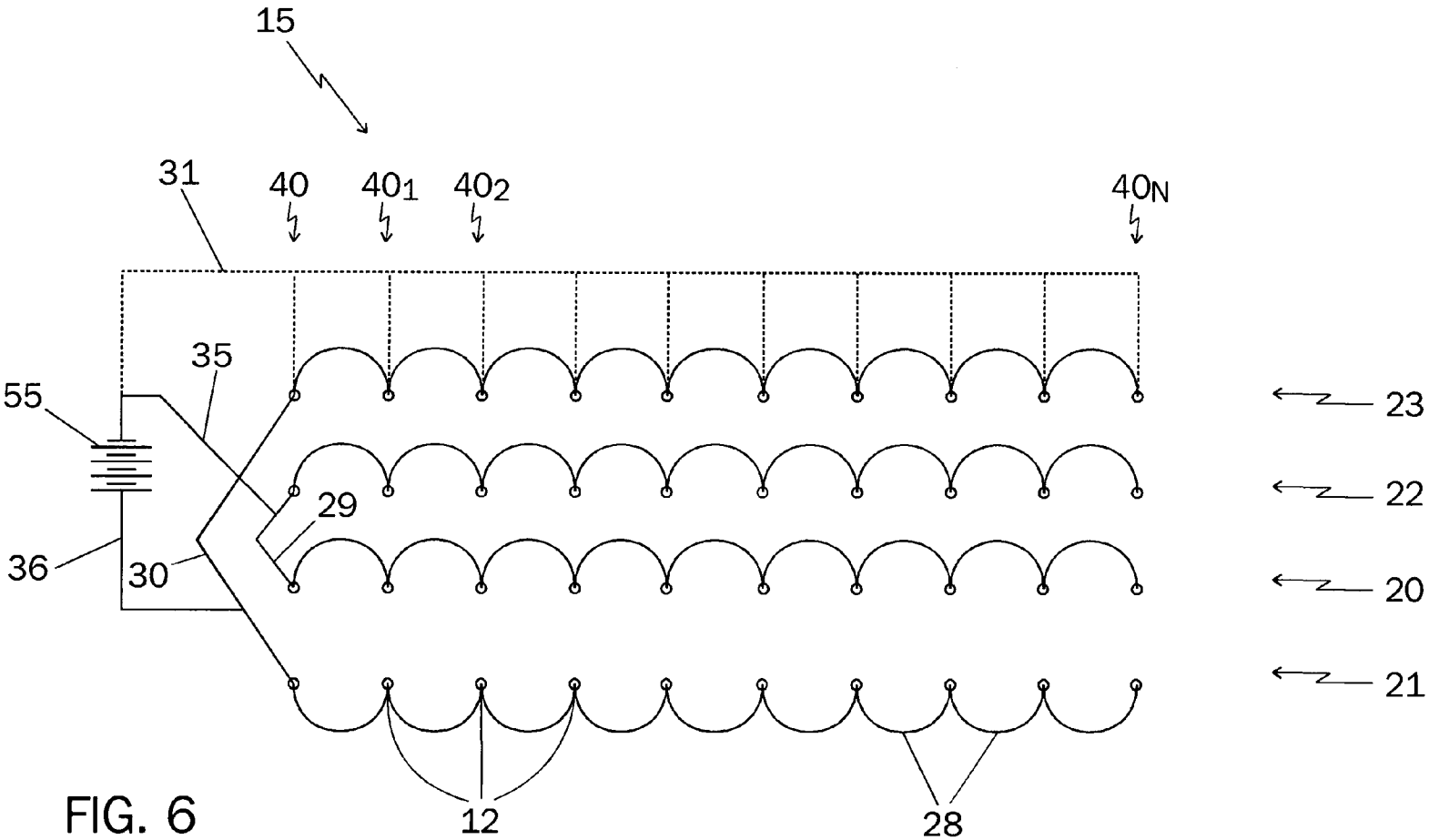
FIG. 6 is a fourth alternate electrical schematic of the connections between electrodes of the apparatus of this invention, a fifth alternate connection shown in dashed lines.

In apparatus 10 shown in FIG. 6, rows 20-23 of electrodes 12 at the cardinal points on orthogonal axes X, Y of tube 11 are alternately charged, that is, electrodes 12 in row 20 and row 22 are charged opposite from electrodes 12 in rows 21 and 23, though it is within the scope of this invention to provide the same charge to adjacent rows, for instance rows 20 and 21, while the opposite charge is applied to the remaining rows 22, 23. It is also within the scope of this invention to provide one charge to a single row while applying the opposing charge to the remainder of rows 20-23. Additionally, though four rows 20-23 are preferred, it is certainly within the scope of this invention to provide for fewer or a greater number of rows as well as to alternately charge electrodes 12 in a single row. In the preferred embodiment, apparatus 10 receives an electrical charge of up to 25 volts direct current from power source 55 and most preferably receives power directly from a twelve (12) volt direct current on-board battery associated with internal combustion engine 50 though, of course, power may be provided by an electrical generating system also associated with internal combustion engine 50. It is also within the scope of this invention to provide a separate power source 55 for apparatus 10.

Finally, it is also within the scope of this invention to differently charge circumferential columns **40-40*n* in parallel or in series. For instance, circumferential column 40 shown in FIG. 4 could be connected to the positive terminal of power source 55 while circumferential column $40_1$ is connected to the negative terminal. Circumferential column $40_2$ may be connected in parallel or series to circumferential column 40 continuing with even numbered circumferential columns 40 until reaching circumferential column $40_n$ and likewise circumferential column $40_1$ is connected in parallel or series to the odd numbered circumferential columns 40**.

Figure 2:
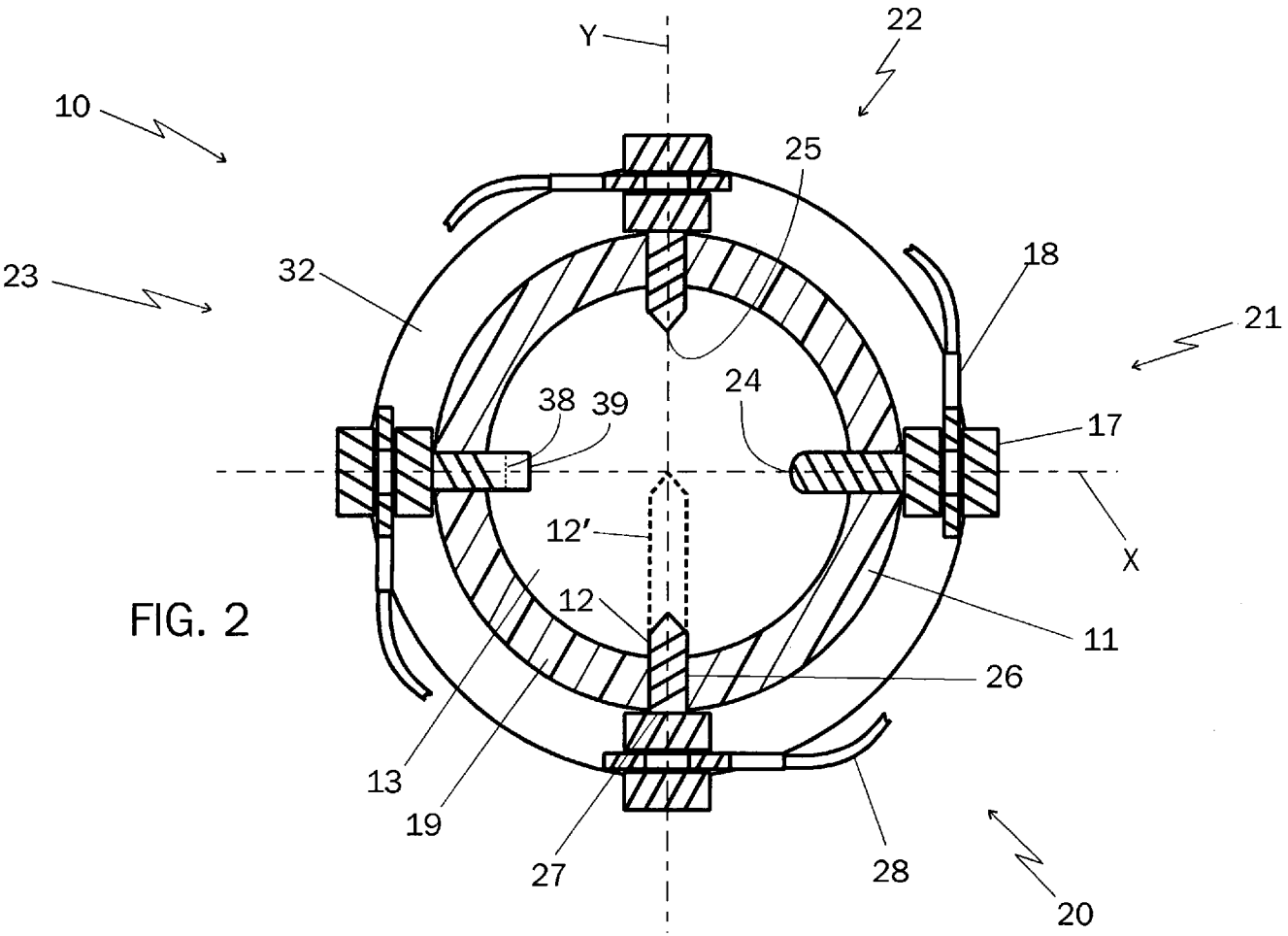
FIG. 2 is an cross sectional end plan view of the preferred embodiment showing a plurality of electrode styles arranged at the cardinal points of the orthogonal axes of the supply line insert of FIG. 1.
Figure 3:
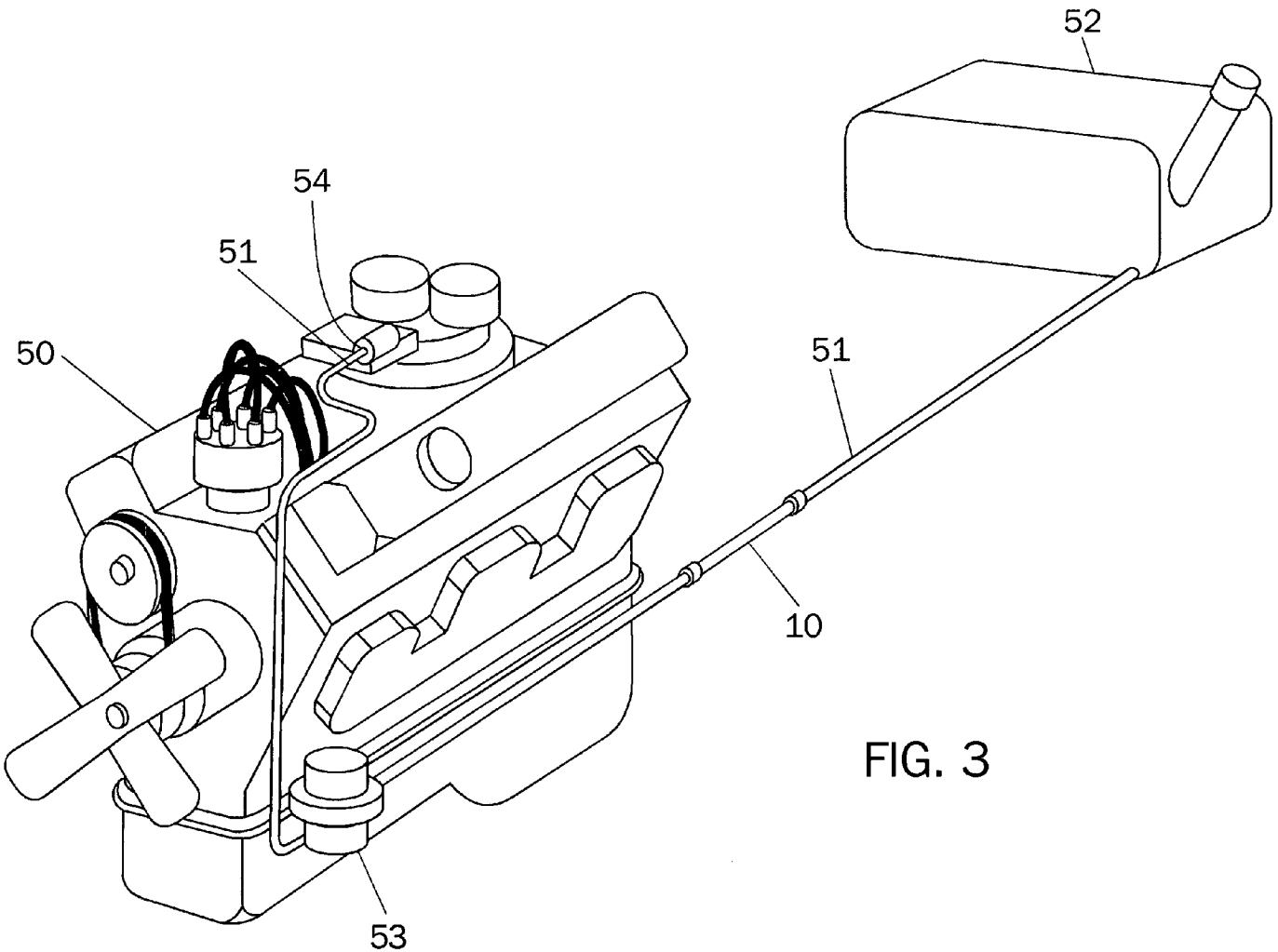
FIG. 3 is schematic view of an internal combustion engine, a fuel supply line and a fuel storage tank, the supply line insert of this invention shown inserted into the fuel supply line.

Referring specifically to FIG. 2, apparatus 10 has electrodes 12 disposed into tube 11 a distance of up to one-half the maximum dimension across the cross section of the fuel passage 13 of tube 11, fuel passage 13 shown as a circular passage, however, it is also within the scope of this invention to provide a cross section for fuel passage 13 that is selected from the group consisting of circular, rectangular, triangular, elliptical or combinations thereof. Preferably, however, electrodes 12 are disposed into fuel passage 13 a distance of approximately three-eighth inch, electrodes 12 of each row 20-23 spaced apart approximately three-eighths of an inch. It has been found by the inventor hereof that three-eighths of an inch between adjacent electrodes 12, with electrodes 12 spaced around apparatus 10 at ninety degree intervals, optimizes the electrical charge imparted to the fuel molecules passing through fuel passage 13, but it is within the scope of this invention to use a greater or lesser spacing and/or angular arrangement, particularly with a different fuel flow rate through fuel passage 13. It has also been found by the inventor hereof that although the preferred protrusion of electrodes 12 into fuel passage 13 is three-eighths of an inch, electrodes 12 need protrude only enough into the fuel stream flowing within fuel passage 13 to impart an electrical charge to the fuel molecules/chains.

Electrodes 12 may have a transverse cross section selected from the group consisting of circular, rectangular, triangular, elliptical or combinations thereof but most preferably, electrodes 12 are circular in cross section and are provided with a terminal end 24 which is a blunt point 39, blunt point 39 preferably extending into fuel passage approximately three-eighths of an inch, however, blunt point 39 may be truncated near an interior surface of wall 19 as shown at 38. It is, however, fully within the scope of this invention to provide for a shape of terminal end 24 that is pointed, i.e., numeral 25 as shown for rows 20 and 22 or rounded, as shown for row 21, and it is also within the scope of this invention to provide for different shapes for terminal end 24 within rows 20-23. Preferably, electrodes 12 are cylindrical plugs with blunt point 39 at terminal end 24, electrodes 12 sealingly inserted into holes 26 disposed through wall 19 of tube 11. Electrodes 12 have an electrical connecting wire 28 associated with an end 27 opposite terminal end 24, electrical connecting wire 28 joining electrodes 12 together with a first electrode 12' of at least one row 20-23 joined to power source 55 preferably according to the solid lines shown on the schematic of FIG. 4. Parallel connections may also be provided as shown in FIG. 6 as dashed lines 15 for one row 23, it being fully understood that any one, or all rows 20-23 may so be connected to power source 55. Additionally, it is within the scope of this invention to stagger electrodes 12 within rows 20-23 from the preceding row, equally spacing electrodes 12 along axis 16 of apparatus 10 between adjacent electrodes 12 by three-eighths an inch.

It is believed that apparatus 10 imparts electrical charges to liquid fuel molecules flowing through fuel passage 13 of fuel supply line 51 of internal combustion engine 50 where apparatus 10 consists of tube 11 inserted into fuel supply line 51 between fuel storage tank 52 and internal combustion engine 50 wherein tube 11 has a plurality 14 of electrodes 12 protruding into fuel passage 13 within tube 11, plurality 14 of electrodes 12 preferably provided with electrical charges of alternating polarity. An opposed charge, that is, either plus or minus, exists at each electrode 12 and it is believed that as fuel molecules pass each particular electrode 12, free bond sites are tied up with the charge existing at the particular electrode 12 such that all free bond sites are captured. Accordingly, the charged fuel molecules do not have affinity for ground potential as each molecule is electrically neutral having had both negative and positive charges affixed thereto by electrodes 12. Additionally, since the electrical charges are imparted to the fuel molecules while the fuel molecules are still in liquid form, and since the voltage is relatively low, no arcing occurs in the fuel line as is prevalent with fuel/air mixtures of the prior art.

Apparatus 10 for imparting electrical charges to liquid fuel molecules has electrodes 12 arranged in rows 20-23 parallel to longitudinal axis 16 of tube 11 with rows 20-23 lying at the major cardinal points of orthogonal axes X, Y of tube 11. As electrodes 12 both positively and negatively charged, it is further believed that turbulence is created in the fuel flowing through fuel passage 13, the turbulence preventing discharge of the charge now attached to the molecules as well as reducing any boundary layer effects present in fluid flow. It is believed that the charge is retained in the fuel flow stream until the fuel in the stream introduced into the cylinders of the internal combustion engine thus enhancing the combustion in the cylinders. Additionally, it is believed that the charge introduced to the fuel stream causes the on-board computer to adjust fuel injector settings to the engine directly resulting in the increased mileage, however, the computer does not optimize until after a short period of operation of a couple of hours. Turbulence of a different order may be created by connecting electrodes 12 in any one of the alternate configurations as shown in FIGS. 4-6. Additionally, another form of turbulence may be created by charging odd numbered circumferential columns 40-40$_n$ of electrodes 12 in row 20-23 positively, while negatively charging the even numbered circumferential columns 40-40$_n$ of electrodes 12. Other arrangements of connections to electrodes 12 are also within the scope of this invention.

Fuel supply line insert 10 comprising elongated tube 11 and plurality 14 of electrodes 12 protruding into fuel passage 13 within fuel supply line insert 10 functions as fuel molecules/chains are polar, carrying a weak plus or minus charge and therefore will accept an electrical charge of the opposite polarity. Thus, plurality 14 of electrodes 12 are arranged on orthogonal axes X, Y of fuel passage 13 so that electrodes 12 impart both positive and negative electrical charges to liquid fuel molecules flowing through fuel passage 13 preferably with plurality 14 of electrodes 12 so arranged as to provide electrical charges of alternating polarity along axis 16 of fuel passage 13. Apparatus 10 excites the weak positive or negative charge of the molecules thus helping molecules of opposite charge to be attracted together. Though turbulence is created in fuel passage 13, it is further believed that the molecules of the fuel generally align with axis 16 upon receiving sufficient electrical charge in fuel supply line insert 10 and as fuel molecules/chains have all free sites bound therefore molecules/chains have no affinity for fuel line 51 after exiting fuel supply line insert 10. Furthermore, with electrodes 12 disposed in the flowing fuel stream, boundary layer losses are alleviated as molecules/chains are not drawn to boundary of pipe as with prior art externally mounted magnets and electrical coil devices. Finally, the inventor hereof has found that it is unnecessary to restrict flow of fuel in order to impart a charge and therefore, by spacing electrodes 12 apart, flow losses are further reduced as no thin film flow is created as in prior art devices. Though direct current is preferred for apparatus 10, alternating current may be applied to electrodes 12 to enhance alignment of molecules/chains and to reduce boundary layer effects.

A model of apparatus 10 was formed from a length of thermoplastic tubing for placement into a fuel line 51, thermoplastic tubing 11 having four rows 20-23 of electrodes 12 inserted into fuel stream passage 13 with electrical attachment points protruding from outside surface of fuel line 51. Columns 40-40$_n$ were created at three-eighths of an inch spacing longitudinally along the length of thermoplastic tube 11 with rows 20-23 spaced apart circumferentially by ninety degrees. Rows 20-23 were interconnected as shown in solid lines in FIG. 4 and charged from a twelve volt automotive battery. Ten electrodes 12 were provided in each row 20-23, electrodes 12 extending into the fuel from the inside surface of wall 19 by approximately three-eighths of an inch. Electrodes 12 were blunt pointed bolts threaded into holes 26 provided through wall 19 of tube 11 with sealant provided on the threads of the bolts. Electrodes 12 were provided with electrical connector 18 attached to electrical connecting wire 28, electrical connector 18 affixed to electrodes 12 with nuts 17 above and below electrical connector 18.

A diesel driven over the road truck, hereinafter, OTR, having at least a million miles of prior service was fitted with the model of apparatus 10. The OTR is a W-900 Kenworth Aerodyne with a 600hp Caterpillar 16L turbocharged diesel engine and pulls a full length refrigerated trailer. The OTR has been maintained in accordance with the manufacturer's recommendations at the intervals specified. The prior service log of the OTR showed an average of about 5.6 miles per gallon of diesel fuel over the million mile service life under various load conditions. Statistically, the range of miles per gallon was from 5.0 to 6.0 mpg with loads ranging from empty, that is about 24000 gross weight, to 78000 pounds full load. Prior road conditions varied from calm winds to a 30 mph head wind and from an ambient temperature of 20 degrees to 90 degrees Fahrenheit. Average quarterly data are shown in Table 1 above the double line with the average of the entire prior service life of the OTRjust above the double line. Since the OTR had been properly tuned just prior to the last over the road run, no further maintenance was performed on the OTR prior to fitting the model of apparatus 10 to the OTR. After fitting the OTR with the model of apparatus 10 and operating internal combustion engine 50 for an interval of about 25 seconds, a change in the tone of the internal combustion engine 50 occurred. Internal combustion engine 50 appeared to run smoother with less clatter than normally associated with diesel engines. The OTR was operated locally for a period of hours to stabilize model of apparatus 10 and it is believed that after about one hundred fifty miles of operation, the on-board computer had optimized the injector pulse width settings. The OTR was then returned to service, and on the first run, with a gross vehicle weight of 42,000 pounds over a distance of 1256 miles, the OTR averaged 6.68 miles per gallon while experiencing a 30 mph head and/or side wind. On the return trip carrying a full load, making the GVW 78,000 pounds, the OTR averaged 6.6 miles per gallon in light winds. It is further believed that the charge imparted to fuel molecules flowing through apparatus 10 is carried to the fuel tanks through the injector rail return line as little drop off in mileage is experienced when refueling the OTR. As there are about 3.2 million trucks driven by diesel engines in operation, each averaging about 100,000 miles per year, an one mile per gallon increase in mileage would result in the savings of 320 billion gallons of fuel resulting in a savings of 880 billion dollars at $2.75 per gallon of fuel. Since apparatus 10 imparts a charge to the fuel flowing through apparatus 10, it is believed that any engine operating on a polar fuel will be positively impacted and therefore, it is believed that internal combustion engines using gasoline, ethanol, butanol, diesel, bio-diesel or combinations of the above will benefit from installation of apparatus 10 of this invention. Table 1 contains data from runs subsequent to installation of the model of apparatus 10, this data shown below the double line. Prior and subsequent runs of the OTR were under essentially identical conditions as the OTR travels over substantially the same routes.

TABLE 1

| Date | GVW | Miles | Conditions | Avg. Speed | Avg. MPG |
|---|---|---|---|---|---|
| 1st Q05 | 24-78000 | 40051 | Winter fuel, cool, rain, ice | 60 mph | 5.30 |
| 2nd Q05 | 24-78000 | 36765 | Moderate Temp, some wind | 60 mph | 5.54 |
| 3rd Q05 | 24-78000 | 43971 | Hot | 60 mph | 5.78 |
| 4th Q05 | 24-78000 | 44104 | Moderate to cool | 60 mph | 5.41 |
| 1st Q06 | 24-78000 | 39231 | Winter fuel, cool | 60 mph | 5.38 |
| All prior Service | 24-78000 | 1000K | Various | 60 mph | 5.6 |
| May 6-May 18, 2006 | 42000 | 1492 | 30 mph wind | 60 mph | 6.84 |
| May 18-May 20, 2006 | 78000 | 1504 | High winds, 90° F. | 60 mph | 6.58 |
| Jun. 7-Jun. 11, 2006 | 50000 | 1850 | High winds, 90° F. | 60 mph | 6.90 |
| Jun. 11-Jun. 13, 2006 | 78000 | 1500 | High head wind, cool | 60 mph | 6.07 |
| Jun. 19-Jun. 19, 2006 | 78000 | 424 | Windy, 92° F., 2.1% idle | 60.5 mph | 6.50 |
| Jun. 19-Jun. 20, 2006 | 78000 | 345 | Strong head winds, 40.6% idle | 36 mph | 5.63 |
| Jun. 20-Jun. 21, 2006 | 78000 | 330 | Strong head winds, 83° F., 34.0% idle | 40 mph | 5.77 |
| Jun. 21-Jun. 21, 2006 | 78000 | 240 | Strong head winds, 83° F. 9.2% idle | 43 mph | 6.01 |
| Jun. 21-Jun. 22, 2006 | 78000 | 379 | 27.4% idle | 43 mph | 6.22 |
| Jun. 22-Jun. 22, 2006 | 78000 | 9 | 41.5% idle | 34 mph | 6.03 |
| Jun. 22-Jun. 22, 2006 | 74170 | 398 | Average conditions, 5.2% idle | 52 mph | 5.94 |
| Jun. 22-Jun. 22, 2006 | 78000 | 241 | Average conditions, 4.7% idle | 55 mph | 5.87 |
| Jun. 23-Jun. 23, 2006 | 78000 | 498 | Average conditions, 3.7% idle | 57 mph | 5.98 |
| Jun. 23-Jun. 23, 2006 | 78000 | 341 | Average conditions, 4.9% idle | 57 mph | 5.98 |
| Jun. 23-Jun. 23, 2006 | 78000 | 225 | Head winds, 5.6% idle | 56 mph | 5.98 |
| Jun. 28-Jun. 28, 2006 | 78000 | 486 | Average conditions, 2.8% idle | 55 mph | 5.82 |
| Jun. 29-Jun. 29, 2006 | 78000 | 253 | Average conditions, 7% idle time | 49 mph | 6.04 |
| Jun. 30-Jun. 30, 2006 | Bobtail | 66 | Average conditions, 10% idle time | 47 mph | 5.82 |

TABLE 1-continued

| Date | GVW | Miles | Conditions | Avg. Speed | Avg. MPG |
|---|---|---|---|---|---|
| Jul. 03-Jul. 03, 2006 | 78000 | 464 | Hot, 6% idle time | 51 mph | 5.26 |
| Jul. 05-Jul. 05, 2006 | 79960 | 1759 | Hot, 3.5% idle | 56 mph | 5.71 |
| Jul. 07-Jul. 07, 2006 | 77000 | 1699 | Hot, 2.3% idle | 60 mph | 5.95 |

Though a single tube has been shown and described as apparatus 10, it is fully within the scope of this invention to arrange at least one other apparatus 10 in either parallel or series combination with a first apparatus 10. For instance, it may be beneficial for space reasons to place one apparatus 10 at a location parallel to a first apparatus 10, both connected to fuel line 51.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. An apparatus for imparting electrical charges to liquid fuel molecules flowing through a fuel passage of a fuel supply line of an internal combustion engine consists of a tube inserted into said fuel supply line between a fuel storage tank and said internal combustion engine, said tube having a plurality of electrodes protruding into said fuel passage within said tube, said plurality of electrodes provided with electrical charges of alternating polarity, said plurality of electrodes connected to a power source said electrodes arranged in rows parallel to a longitudinal axis of said tube, said rows lying at the major cardinal points of orthogonal axes of said tube, said electrodes lying on a vertical orthogonal axis of said tube positively charged.

2. An apparatus for imparting electrical charges to liquid fuel molecules as described in claim 1 wherein said electrodes lying on a horizontal orthogonal axis of said tube are negatively charged.

3. An apparatus for imparting electrical charges to liquid fuel molecules as described in claim 1 wherein said electrodes lying on said vertical orthogonal axis of said tube are connected in parallel.

* * * * *